US007371133B1

(12) United States Patent
Morello et al.

(10) Patent No.: US 7,371,133 B1
(45) Date of Patent: May 13, 2008

(54) ELECTRICAL SOCKET TERMINAL HAVING A CONTACT STABILIZER

(75) Inventors: John R. Morello, Warren, OH (US); William G. Strang, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/654,862

(22) Filed: Jan. 18, 2007

(51) Int. Cl.
*H01R 11/22* (2006.01)

(52) U.S. Cl. ..... 439/852

(58) Field of Classification Search ..... 439/852, 439/862

See application file for complete search history.

(56) References Cited

U.S. PATENT DOCUMENTS 3,713,080 A * 1/1973 Kennedy ..... 439/852
4,717,356 A * 1/1988 Rahrig et al. ..... 439/464
5,281,175 A * 1/1994 Chupak et al. ..... 439/839
5,399,110 A 3/1995 Morello et al.
6,200,174 B1 * 3/2001 Katoh et al. ..... 439/862
6,494,751 B1 12/2002 Morello et al.
6,676,456 B1 * 1/2004 Horng ..... 439/862
7,048,584 B1 5/2006 Morello et al.
2002/0068479 A1 6/2002 Morello et al.
2003/0109181 A1 * 6/2003 Bungo ..... 439/852
2005/0287878 A1 12/2005 Urbaniak et al.
2006/0292937 A1 * 12/2006 Morello et al. ..... 439/856

* cited by examiner

*Primary Examiner*—Neil Abrams
*Assistant Examiner*—Phuongchi Nguyen
(74) *Attorney, Agent, or Firm*—David P. Wood

(57) ABSTRACT

An electrical socket terminal includes a socket housing defining a cavity. The socket housing includes a first set of walls, a second set of rigid walls connected to the first set of wall and spacing the first set of walls apart, and at least one resilient socket contact inwardly depending from the first set of walls into the cavity. The socket contact(s) include at least one inwardly depending stabilizer adapted to laterally restrain a plug contact.

7 Claims, 2 Drawing Sheets

ELECTRICAL SOCKET TERMINAL HAVING A CONTACT STABILIZER

FIELD OF THE INVENTION

This invention relates generally to electrical connectors and, more particularly, to electrical terminals for electrical connectors.

BACKGROUND OF THE INVENTION

Electrical terminals are well known for connecting various types of electrical elements to one another. Electrical terminals include socket terminals and plug terminals for insertion into the socket terminals. A typical plug terminal includes an elongated plug contact, and a typical socket terminal includes a socket housing defining a cavity for sliding receipt of the plug contact. The typical socket housing includes rigid sidewalls and oppositely disposed resilient socket contacts biased toward one another. The plug contact is disposed between the sidewalls and is releasably secured in electrical contact between the socket contacts to form a readily separable electrical joint. While such terminals are suitable for many applications, the plug contact laterally moves between and vibrates against the socket housing sidewalls. Vibration leads to localized fretting of the terminals, which leads to plating wear and, eventually, oxidation and concomitant failure of the terminals. To reduce vibration, the plug contact is interference fit between the rigid sidewalls of the socket housing. But this tight configuration results in unacceptably high terminal-to-terminal engagement and disengagement forces.

SUMMARY OF THE INVENTION

An electrical socket terminal includes a socket housing defining a cavity. The socket housing includes a first set of walls, a second set of rigid walls connected to the first set of walls and spacing the first set of walls apart. The socket housing also includes at least one resilient socket contact inwardly depending into the cavity from at least one of the first set of walls and including at least one inwardly depending stabilizer adapted to laterally restrain a plug contact.

DETAILED DESCRIPTION OF THE PREFERRED EMBODIMENTS

Figure 1:
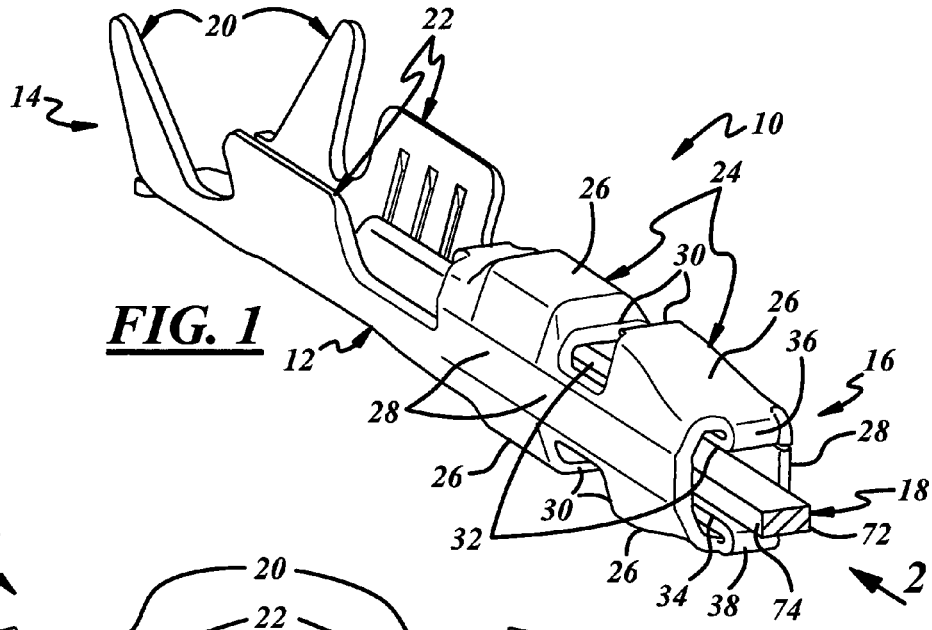
FIG. 1 is a perspective view of an electrical terminal assembly illustrating an electrical socket terminal and a portion of an electrical plug terminal received within the socket terminal.
Figure 2:
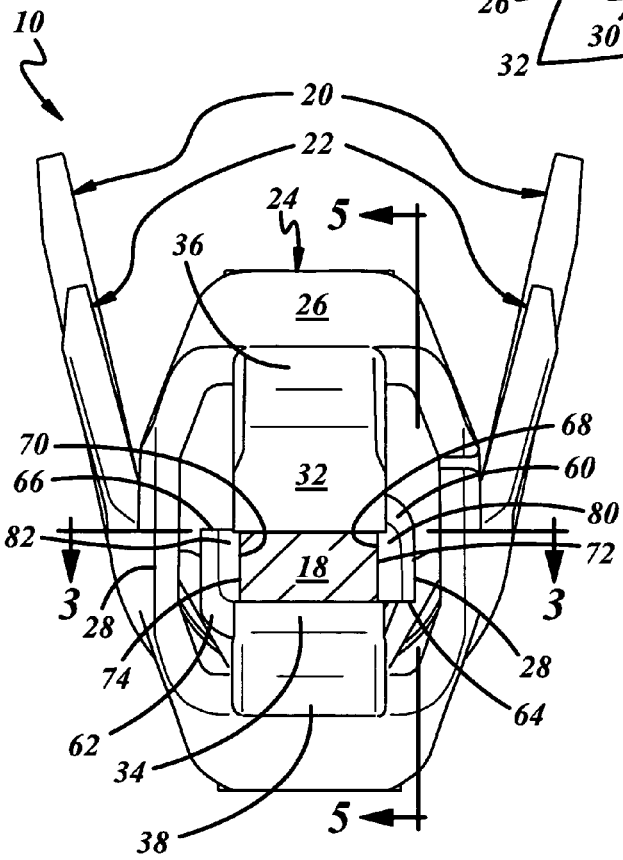
FIG. 2 is an end view of the electrical terminal assembly of FIG. 1, taken along line 2-2 thereof.

Referring now to the drawings, FIGS. 1 and 2 partially illustrate an exemplary electrical terminal assembly 10 for electrically intercommunicating other electrical devices (not shown) such as wires, circuit board elements, or the like. The terminal assembly 10 includes an exemplary electrical socket terminal 12, which includes a rear end 14 for electrical communication with a wire (not shown) and an oppositely disposed front end 16 for electrical communication with a longitudinally extending plug contact 18 of an exemplary electrical plug terminal, the rest of which is not shown. The contact 18 may be a generally rectangular-shaped blade, as shown, or may be any other suitable element such as a rod, rigid wire, or the like, of any suitable shape and size.

The socket terminal 12 can be any suitable conductive terminal for receiving a complementary plug terminal. For example, the socket terminal 12 can include a set of sheath clamps 20 at the rear end for clamping a wire insulation jacket (not shown), and a set of wire clamps 22 forward of the sheath clamps 20 for clamping wire strands (not shown). In any case, the socket terminal 12 includes a socket housing 24 disposed forward of the clamps 20, 22.

The socket housing 24 receives the plug contact 18 therein for electrical contact therewith. The socket housing 24 has a plurality of walls including a first set of walls 26 and a second set of walls 28, with oppositely disposed recesses 30 therein for cooperating with a socket connector body (not shown) adapted to carry the socket terminal 12. In general, the walls 26, 28 are rigid and the second set of walls 28 spaces the first set of walls 26 apart. The socket housing 24 also includes one or more resilient socket contacts 32, 34 integrally connected to the first set of walls 26 at bent ends 36. As used herein, the term resilient includes a general ability of a member to recover its free state after being displaced or deformed in a vertical, lateral, and/or torsional direction.

Figure 5:
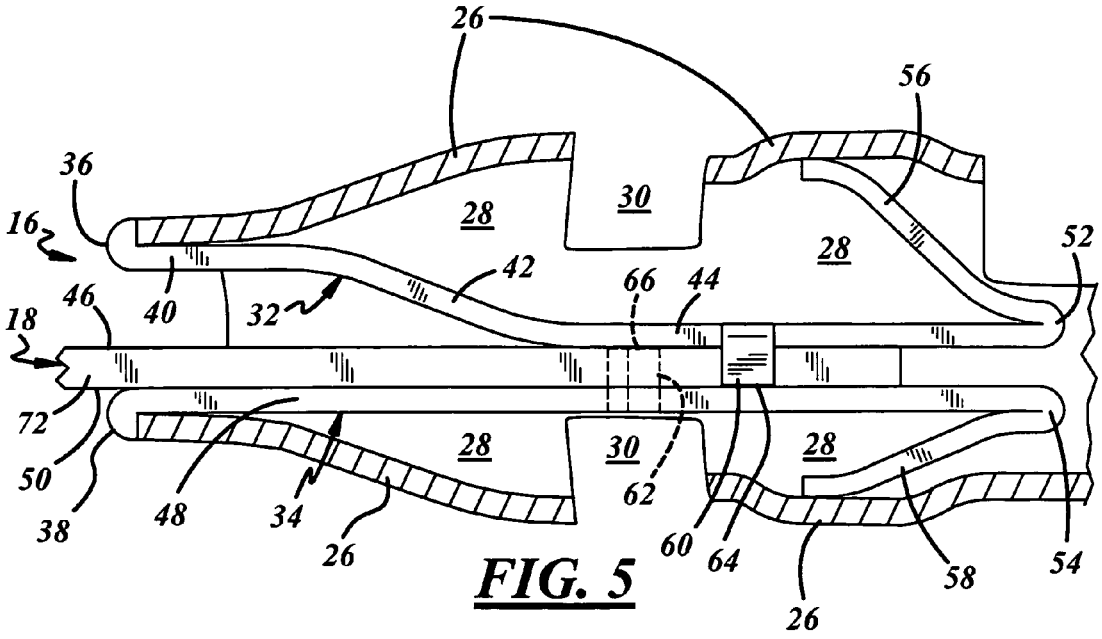
FIG. 5 is a cross-sectional view of a portion of the electrical terminal assembly of FIG. 2, taken along line 5-5 thereof.

As shown in FIG. 5, a first resilient socket contact 32 extends inwardly into the cavity defined by the socket housing 24. More specifically, the first resilient socket contact 32 includes a forward straight portion 40 extending rearwardly and spaced away from the plug contact 18 at the front end 16, an inwardly depending sloped portion 42 rearward of the forward, straight portion 40, and a rearward straight portion 44 in contact with a first surface 46 of the plug contact 18. In contrast, a second resilient socket contact 34 extends rearwardly, and is defined primarily by a single straight portion 48 in contact with a second surface 50 of the plug contact 18. However, both resilient socket contacts 32, 34 can also include rearward bent portions 52, 54 and leaf springs 56, 58 in biased contact with an inside surface of the first set of walls 26. Unlike conventional terminal assemblies, the plug contact 18 need not be in contact with the second set of walls 28 of the socket housing 24 and, yet, the plug contact 18 can be resiliently, laterally restrained therein.

This is because, as best shown in FIG. 2, one or more of the socket contacts 32, 34 includes one or more integral stabilizers 60, 62 inwardly depending from sides of the contacts 32, 34. The stabilizers 60, 62 are preferably relatively stiff or rigid, or can be resilient to provide additional resiliency above and beyond the resiliency provided by the contacts 32, 34 themselves. In any case, the contacts 32, 34, via the stabilizers 60, 62, laterally restrain the plug contact 18 resiliently between the contacts 32, 34 and, preferably, inwardly of the second set of walls 28 so as to reduce vibration of the longitudinally extending plug contact 18 within the socket housing 24.

Referring also to FIG. 5, the first resilient socket contact 32 includes a first stabilizer 60. The first stabilizer 60 preferably extends from a lateral edge of the rearward straight portion 44 thereof, approximately midway along the length of the straight portion 44. Similarly, the second resilient socket contact 34 includes a second stabilizer 62. Preferably, the second stabilizer 62 extends from a lateral edge of the straight portion 48 thereof, approximately midway along the length of the straight portion 48. The stabilizers 60, 62 are integrally cantilevered from the contacts 32, 34, extend radially inwardly toward respectively opposed contacts 34, 32, and terminate in free ends 64, 66.

Figure 3:
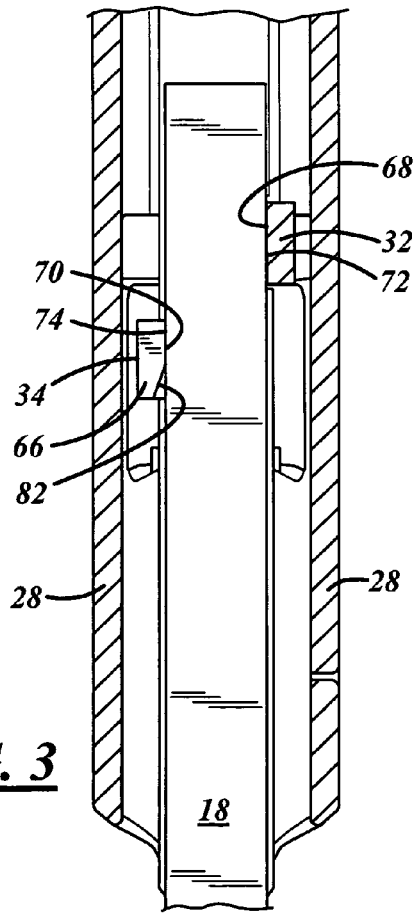
FIG. 3 is a cross-sectional view of a portion of the electrical terminal assembly of FIG. 2, taken along line 3-3 thereof.
Figure 4:
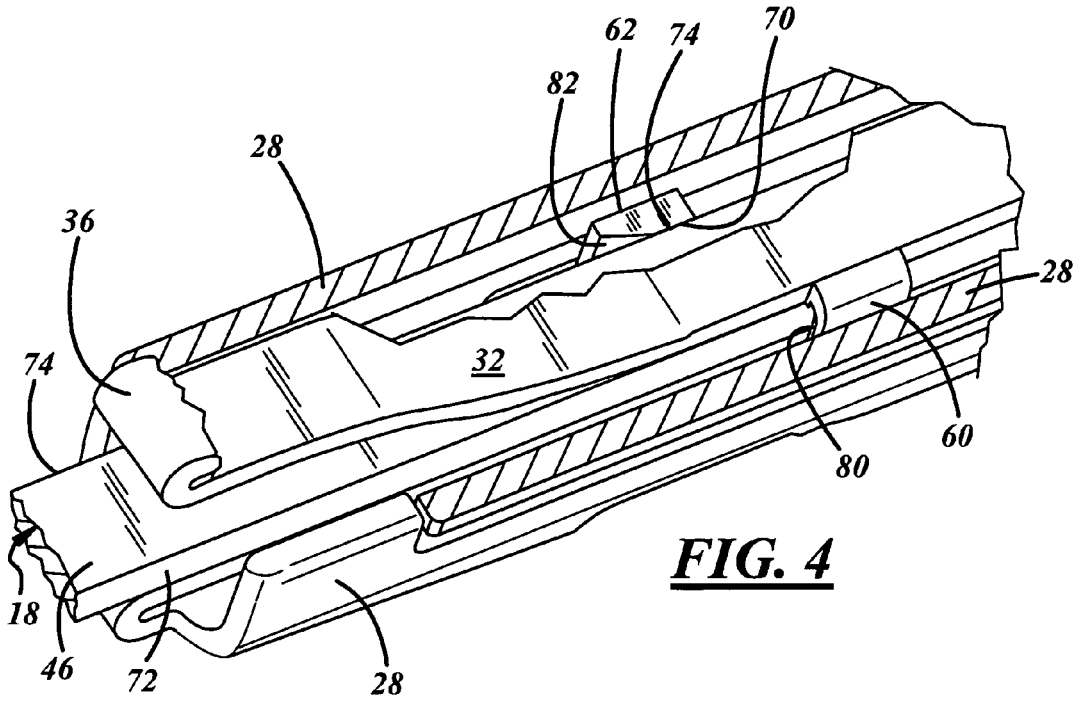
FIG. 4 is a fragmented, partially cross-sectional, perspective view of a portion of the electrical terminal assembly of FIG. 1.

As best shown in FIGS. 3 and 4, the stabilizers 60, 62 are generally laterally opposed, but can also be longitudinally offset such that one is disposed relatively rearward of the other. The stabilizers 60, 62 could instead be directly laterally opposed across from one another. As best shown in FIGS. 2 and 3, the stabilizers 60, 62 include inboard surfaces 68, 70 adapted for contact with outboard surfaces 72, 74 of the plug contact 18. The stabilizers 60, 62 can be of any suitable shape, size, and configuration. For example, the stabilizers 60, 62 can generally be tabs of rectangular-shaped cross-sectional profile, as shown.

Referring to FIG. 2, as assembled to the plug terminal-contact 18, the stabilizers 60, 62 are relatively squarely oriented with respect to respective surfaces of the plug and socket contacts 18, 32, 34. But before the plug terminal contact 18 is inserted, the stabilizers 60, 62 can be angled in an inboard direction to provide any desired lateral spacing therebetween to vary an interference fit, of the plug contact 18 therebetween. In any case, the distance between the inboard surfaces 72, 74 of the stabilizers 60, 62 is preferably smaller than the width of the plug contact 18 or the distance between the outbard surfaces 76, 78 thereof to establish any suitable interference fit.

Because of the interference fit, the contacts 32, 34, by way of the stabilizers 60, 62, tend to impose opposite lateral forces against the plug contact 18 to firmly hold the plug contact 18 laterally between the stabilizers 60, 62. But because the contacts 32, 34 are resilient, such forces are not excessive so that the plug contact 18 can be inserted into and removed from the socket housing 24 with reasonable engagement force effort. The stabilizers 60, 62 are preferably beveled at forward ends thereof to include lead-in chamfers 80, 82 to facilitate assembly of the plug contact 18 between the stabilizers 60, 62. And, of course, the socket contacts 32, 34 generally tend to impose normal forces against the plug contact 18 to firmly hold the plug contact 18 between the straight portions 44, 48 of the socket contacts 32, 34.

The main lateral resiliency offered by the terminal 12 predominantly comes from the lateral resiliency of the socket contact members 32, 48. The socket contacts 32, 34 tend to provide equal and opposite stabilized loading in the vertical or normal direction, the lateral direction, and/or a torsional direction. Because of this combined resilient loading effect, the plug contact 18 is very stably held within the terminal 12 between the contacts 32, 34 so as to reduce terminal-to-terminal vibration.

The socket terminal 12 can be manufactured in any suitable manner. For example, the terminal 12 can be manufactured according to any suitable progressive die stamping and bending processes, which are well known to those skilled in the art. Accordingly, a blank of material can be die stamped, and then bent into the final configuration illustrated in FIGS. 1 through 5.

Although it is preferred to use at least two laterally opposed stabilizers on at least two normally opposed resilient socket contacts, other embodiments are contemplated. For example, just one resilient socket contact could include just one or more stabilizers to laterally restrain a plug contact. In this case, a plug contact could be resiliently restrained between a rigid wall of a socket housing and the one or more stabilizers depending from the socket contact so as to reduce vibration of the plug contact within the socket housing. In another example, multiple laterally opposed stabilizers could be carried by just one resilient socket contact, such that a plug contact is held between stabilizers of a single contact. Of course, the size, shape, and configuration of the housing and the plug contact would vary from that shown in FIGS. 1 through 5 to accommodate these alternatives.

The present invention thus provides a simple and inexpensive means to resiliently restrain a plug contact within a socket terminal between socket contacts. The socket contacts resiliently deflect in normal and lateral directions to allow for plug terminal contact alignment and tolerance variations. The plug contact is restrained therein with acceptable terminal-to-terminal engagement and disengagement forces, and against lateral movement to avoid vibration between plug and socket terminals. Accordingly, the present invention socket terminal will incur relatively less localized fretting, plating wear, oxidation, and concomitant failure thereof.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptions, variations, modifications and equivalent arrangements, the present invention being limited only by the following claims and the equivalents thereof.

We claim:

1. An electrical socket terminal comprising:

a socket housing defining a cavity and including:

a first set of walls;

a second set of rigid walls connected to the first set of walls and spacing the first set of walls apart; and at least one resilient socket contact inwardly depending from the first set of walls into the cavity and including at least one inwardly depending stabilizer adapted to laterally restrain a plug contact, wherein the at least one resilient socket contact includes a first resilient socket contact and an oppositely disposed second resilient socket contact, and further wherein the at least one stabilizer includes a first stabilizer inwardly depending from the first resilient socket contact and a second stabilizer inwardly depending from the second resilient socket contact and being laterally spaced from the first stabilizer.

2. An electrical socket terminal adapted to cooperate with an electrical plug terminal having a longitudinally extending plug contact, the electrical socket terminal comprising:

a socket housing defining a cavity, and including:

a first set of walls;

a second set of rigid walls connected to the first set of walls and spacing the first set of walls apart;

at least two opposed resilient socket contacts inwardly depending from respective ones of the first set of walls into the cavity, each of the at least two opposed resilient socket contacts including a stabilizer inwardly depending therefrom, the stabilizers being adapted to engage the plug contact of the electrical plug terminal to resiliently restrain lateral movement of the plug contact.

3. The electrical socket terminal of claim 2, wherein the stabilizers are laterally opposed and adapted for an interference fit with the plug contact of the electrical plug terminal.

4. The electrical socket terminal of claim 3, wherein the stabilizers are substantially rectangular in cross-sectional profile.

5. An electrical socket terminal adapted to cooperate with an electrical plug terminal having a longitudinally extending plug contact, the electrical socket terminal comprising:

a socket housing defining a cavity, and including:

a first set of walls;

a second set of rigid walls connected to the first set of walls and spacing the first set of walls apart;

at least two opposed resilient socket contacts inwardly depending from the first set of walls into the cavity and including stabilizers inwardly depending therefrom and being adapted to engage the plug contact of the electrical plug terminal to resiliently restrain lateral movement of the plug contact, wherein the stabilizers are laterally opposed and adapted for an interference fit with the plug contact of the electrical plug terminal, and wherein the stabilizers are also longitudinally offset.

6. An electrical terminal assembly comprising:

an electrical plug terminal having a longitudinally extending plug contact; and an electrical socket terminal for receiving the plug contact of the electrical plug terminal, and comprising:

a socket housing defining a cavity, and including:

a first set of walls;

a second set of rigid walls connected to the first set of walls and spacing the first set of walls apart;

a pair of opposed resilient socket contacts inwardly depending from respective ones of the first set of walls into the cavity and including laterally opposed and spaced stabilizers inwardly depending therefrom respectively and being engaged with the plug contact of the electrical plug terminal to resiliently restrain lateral movement of the plug contact so as to reduce vibration of the plug contact within the socket housing.

7. The electrical socket assembly of claim 6, wherein the plug contact is in an interference fit between the laterally opposed stabilizers.

* * * * *